US009400132B2

(12) United States Patent
Shrader et al.

(10) Patent No.: US 9,400,132 B2
(45) Date of Patent: Jul. 26, 2016

(54) REFRIGERATOR, INSULATED DOOR MOUNTED ON AN INSULATED CABINET OF A REFRIGERATOR, AND ARTICLE DISPENSER FOR MOUNTING WITHIN ONE OR MORE RECESSES OF AN INNER WALL OF A REFRIGERATOR DOOR

(71) Applicant: Electrolux Home Products, Inc., Charlotte, NC (US)

(72) Inventors: Benjamin P. Shrader, Charlotte, NC (US); Brent Curtis, Anderson, SC (US); Samuel Chi Chiu Li, Albany, NY (US); Justin Shaun Elgin, Anderson, SC (US)

(73) Assignee: ELECTROLUX HOME PRODUCTS, INC., Charlotte, NC (US)

( * ) Notice: Subject to any disclaimer, the term of this patent is extended or adjusted under 35 U.S.C. 154(b) by 4 days.

(21) Appl. No.: 14/250,897

(22) Filed: Apr. 11, 2014

(65) Prior Publication Data

US 2015/0292792 A1 Oct. 15, 2015

(51) Int. Cl.

| | |
|---|---|
| ***F25D 23/04*** | (2006.01) |
| ***F25D 23/02*** | (2006.01) |
| ***A47F 1/08*** | (2006.01) |

(52) U.S. Cl.

CPC . *F25D 23/02* (2013.01); *A47F 1/08* (2013.01); *F25D 23/04* (2013.01); *F25D 2331/805* (2013.01)

(58) Field of Classification Search

CPC ..... F25D 23/04; F25D 23/123; F25D 25/02; F25D 23/02; G07F 11/08; A47F 1/08

USPC ..... 312/401, 405, 405.1, 321.5, 45, 72; 62/377; 220/476, 480, 482; 211/59.2; 221/67, 103, 104, 111

See application file for complete search history.

(56) References Cited

U.S. PATENT DOCUMENTS

| | | | | |
|---|---|---|---|---|
| 1,753,957 | A | 2/1928 | Washburn | |
| 1,898,056 | A | 7/1930 | Johnson | |
| 2,074,438 | A * | 3/1937 | Swedman | 220/480 |
| 2,135,878 | A * | 11/1938 | Sekyra, Sr. | 62/252 |
| 2,826,471 | A | 3/1958 | Fonda | |
| 3,178,061 | A * | 4/1965 | Giacalone et al. | 222/129 |

(Continued)

FOREIGN PATENT DOCUMENTS

| | | | |
|---|---|---|---|
| DE | 4317615 | A1 * | 12/1994 |
| EP | 1030141 | A2 | 8/2000 |

(Continued)

OTHER PUBLICATIONS

International Search Report and Written Opinion issued in Application No. PCT/US2015/024625 dated Jun. 16, 2015.

*Primary Examiner* — James O Hansen

(74) *Attorney, Agent, or Firm* — Pearne & Gordon LLP

(57) ABSTRACT

A refrigerator may include an insulated cabinet configured to preserve food, an insulated door mounted on the insulated cabinet, the insulated door being configured to close the insulated cabinet, the insulated door including an inner wall, the inner wall including one or more recesses, and an article dispenser including a dispensing portion and a mounting portion on a back side of the dispensing portion, the mounting portion being configured to removably mount the dispensing portion within the recesses, the dispensing portion being configured to store one or more articles and dispense the articles according to a user's demand.

16 Claims, 5 Drawing Sheets

(56) References Cited

U.S. PATENT DOCUMENTS

| | | | | |
|---|---|---|---|---|
| 3,469,711 | A * | 9/1969 | Swaneck et al. | 312/351 |
| 3,923,159 | A | 12/1975 | Taylor et al. | |
| 5,143,252 | A | 9/1992 | Shi | |
| 5,778,117 | A | 7/1998 | Inoue et al. | |
| 5,927,840 | A * | 7/1999 | Bzowski | 312/321.5 |
| 6,694,771 | B2 | 2/2004 | Kim et al. | |
| D509,689 | S | 9/2005 | Ho | |
| 7,150,155 | B2 | 12/2006 | Faber | |
| 7,300,120 | B2 * | 11/2007 | Shin | 312/404 |
| 7,377,123 | B2 | 5/2008 | Byrne et al. | |
| 7,703,865 | B2 * | 4/2010 | Knoller | 312/405.1 |
| 7,922,437 | B1 | 4/2011 | Loftin et al. | |
| 7,922,747 | B2 | 4/2011 | Kirschman | |
| 7,980,417 | B2 * | 7/2011 | Riley | G07F 9/02 221/277 |
| 8,608,263 | B2 | 12/2013 | Eveland et al. | |
| 2003/0011291 | A1 * | 1/2003 | Moreno-Olguin et al. | 312/405.1 |
| 2003/0046951 | A1 | 3/2003 | Kim et al. | |
| 2006/0010829 | A1 * | 1/2006 | de Sa Cavalcanti et al. | 52/784.1 |
| 2010/0295424 | A1 * | 11/2010 | Alexander | 312/109 |
| 2010/0326122 | A1 * | 12/2010 | Seo et al. | 62/449 |
| 2013/0334952 | A1 * | 12/2013 | Meese | 312/405.1 |
| 2014/0360220 | A1 * | 12/2014 | Rackley et al. | 62/377 |

FOREIGN PATENT DOCUMENTS

| | | | |
|---|---|---|---|
| JP | S4854358 | U | 7/1973 |
| JP | S54145862 | U | 10/1979 |
| JP | H04194578 | A | 7/1992 |
| KR | 10-2006-0002558 | A | 1/2006 |
| WO | 2005059455 | A1 | 6/2005 |

* cited by examiner

REFRIGERATOR, INSULATED DOOR MOUNTED ON AN INSULATED CABINET OF A REFRIGERATOR, AND ARTICLE DISPENSER FOR MOUNTING WITHIN ONE OR MORE RECESSES OF AN INNER WALL OF A REFRIGERATOR DOOR

BACKGROUND

1. Field

The following description relates to a refrigerator, an insulated door mounted on an insulated cabinet of a refrigerator, and an article dispenser for mounting within one or more recesses of an inner wall of a refrigerator door.

2. Description of Related Art

Storage bins and racks are provided in refrigerators and freezers in order to maximize the storage space thereof. Occasionally, storage bins and racks are designed to have specific purposes, such as being devoted to small dairy products, two-liter beverages, or milk jugs. Some storage bins and racks are also occasionally designed to perform particular functions, such as the chilling of particular beverages at an accelerated rate or the maintaining of certain articles in protective orientations or positions contributing to ease of accessibility.

SUMMARY

In one general aspect, a refrigerator may include an insulated cabinet configured to preserve food, an insulated door mounted on the insulated cabinet, the insulated door being configured to close the insulated cabinet, the insulated door including an inner wall, the inner wall including one or more recesses, and an article dispenser including a dispensing portion and a mounting portion on a back side of the dispensing portion, the mounting portion being configured to removably mount the dispensing portion within the recesses, the dispensing portion being configured to store one or more articles and dispense the articles according to a user's demand.

In another general aspect, an insulated door mounted on an insulated cabinet of a refrigerator may be provided. The insulated door may include an inner wall including one or more recesses, and an article dispenser including a dispensing portion and a mounting portion on a back side of the dispensing portion, the mounting portion being configured to removably mount the dispensing portion within the recesses, the dispensing portion being configured to store one or more articles and dispense the articles according to a user's demand to close the insulated cabinet.

An article dispenser may be on an inner wall of the insulated door, the dispenser including a dispensing portion and a mounting portion on a back side of the dispensing portion, the dispensing portion being configured to store one or more articles and dispense the articles according to a user's demand, the mounting portion being configured to removably mount the dispensing portion within one or more recesses in the inner wall.

The mounting portion may be further configured to enable the article dispenser to slide horizontally within the recesses in the inner wall.

The opening of each of the recesses may be partially defined by a rail that, along with the recess, extends horizontally across a substantial width of the inner wall. The mounting portion may include one or more mounting members, the mounting members being configured to rest and slide on the horizontal rails corresponding with the one or more recesses within which the mounting members are removably mounted, the mounting members being further configured to extend past the corresponding horizontal rails into the recesses.

The mounting members may include curved fasteners.

A first plurality of the mounting members may be slidably and removably mounted in a first one of the recesses. A second plurality of the mounting members may be slidably and removably mounted in a second one of the recesses located below and adjacent to the first one of the recesses.

An opening of each of the recesses may be defined by a hole in the inner wall. A plurality of the holes may extend in horizontal rows across a substantial width of the inner wall. The mounting portion may include one or more mounting members, the mounting members being configured to rest on portions of the inner wall corresponding with the holes defining the recesses within which the mounting members are removably mounted, the mounting members being further configured to extend past the corresponding inner wall portions into the recesses.

The mounting members may include hooks.

A first plurality of the mounting members may be removably mounted in a corresponding first plurality of the recesses along a first one of the horizontal rows. A second plurality of the mounting members may be removably mounted in a corresponding second plurality of the recesses along a second one of the horizontal rows, the second one of the horizontal rows being located adjacent to and below the first set of horizontal rows.

In another general aspect, an article dispenser for mounting within one or more recesses of an inner wall of a refrigerator door may be provided. The dispenser may include a dispensing portion configured to store one or more articles and dispense the articles according to a user's demand, and a mounting portion on a back side of the dispensing portion, the mounting portion being configured to removably mount the dispensing portion within the recesses.

The mounting portion may include mounting members extending from the mounting portion that correspond with locations of the recesses.

The mounting members may be configured to rest on horizontal rails defining an opening of the recesses and extend from the horizontal rails into the recesses.

The mounting members may be configured to rest on portions of the inner wall defining an opening of the recesses and extend from the inner wall portions into the recesses.

The mounting members may include a first plurality and a second plurality of the mounting members, the first plurality of the mounting members being slidably and removably mounted in a first one of the recesses, the second plurality of the mounting members being slidably and removably mounted in a second one of the recesses located below and adjacent to the first one of the recesses.

The mounting members may include a first plurality and a second plurality of the mounting members, the first plurality of the mounting members being removably mounted in a corresponding first plurality of recesses that extend across a substantial width of the inner wall, the second plurality of the mounting members being removably mounted in a corresponding second plurality of recesses that extend the substantial width of the inner wall and are located adjacent and below the first plurality of recesses.

The dispensing portion may include a bottom wall, a step, and an article dispensing area, the step being elevated from the bottom wall and provided in a rear portion of the dispensing portion, the step being configured to urge articles falling from an upper portion of the dispensing portion into the article holding area to enable retrieval by the user.

The dispensing portion may include a bottom wall, an article holding area extending upwards from the bottom wall, and an article dispensing area extending outwards from the article holding area on the bottom wall, the article holding area being defined by walls configured to surround the articles and store the articles until required by the user's demand, the article dispensing area being configured to hold one of the articles apart from the stored articles for retrieval by the user. The articles may be surrounded and stored in the article holding area may be configured to move toward the bottom wall with a retrieval of the one of the articles from the article dispensing area.

The articles may include a plurality of cylindrical beverage containers.

The cylindrical beverage containers may be separated from surfaces of the article holding area by a carton configured to hold the cylindrical beverage containers.

Other features and aspects may be apparent from the following detailed description, the drawings, and the claims.

Figure 1:
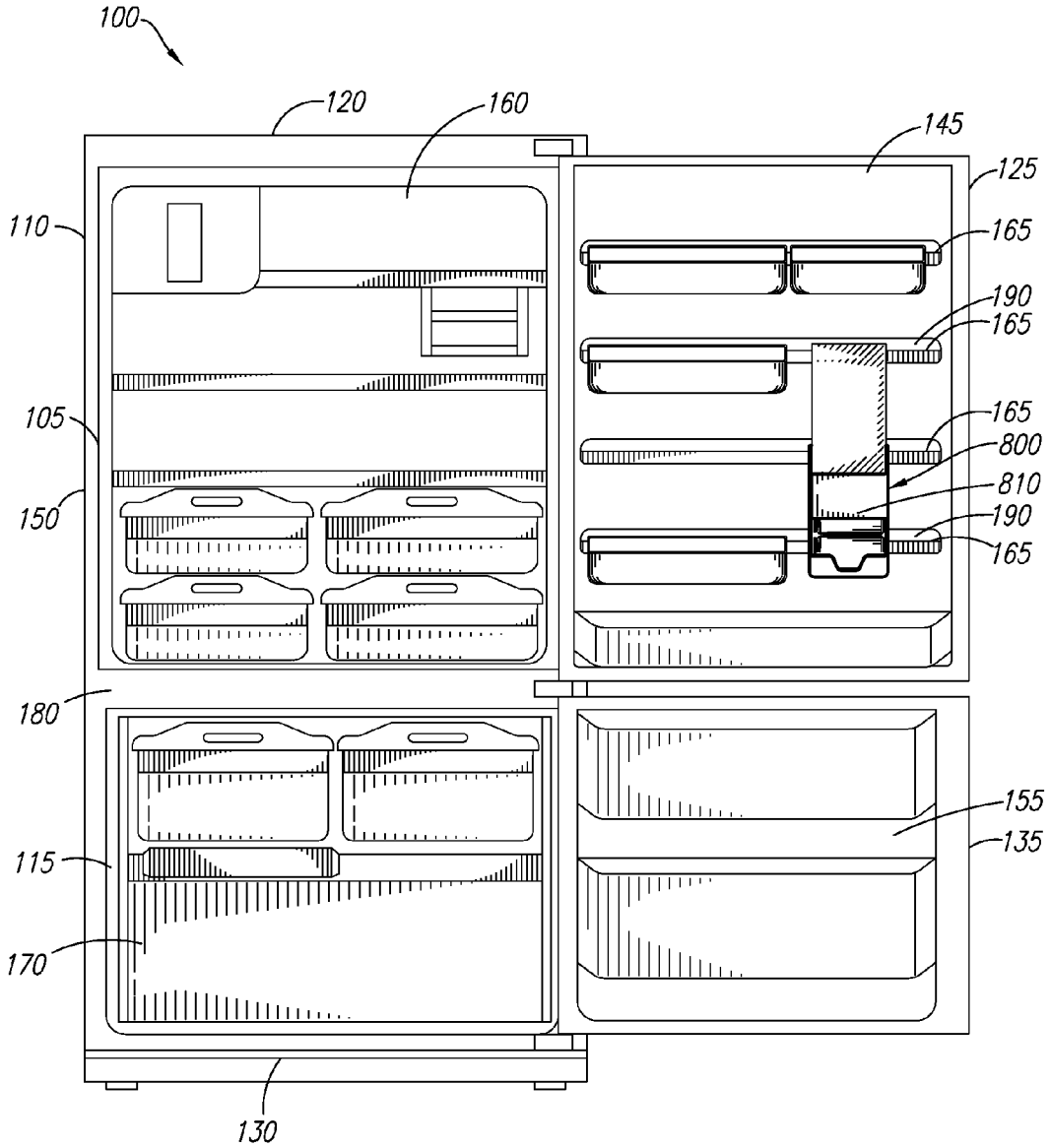
FIG. 1 is a front view illustrating an example of a refrigerator according to an embodiment.

Throughout the drawings and the detailed description, unless otherwise described, the same drawing reference numerals will be understood to refer to the same elements, features, and structures. The relative size and depiction of these elements may be exaggerated for clarity, illustration, and convenience.

DETAILED DESCRIPTION

Examples incorporating one or more embodiments are described and illustrated in the drawings. These illustrated examples are not intended to be limiting. For example, one or more aspects of an embodiment may be utilized in other embodiments and even other types of devices.

Figure 2:
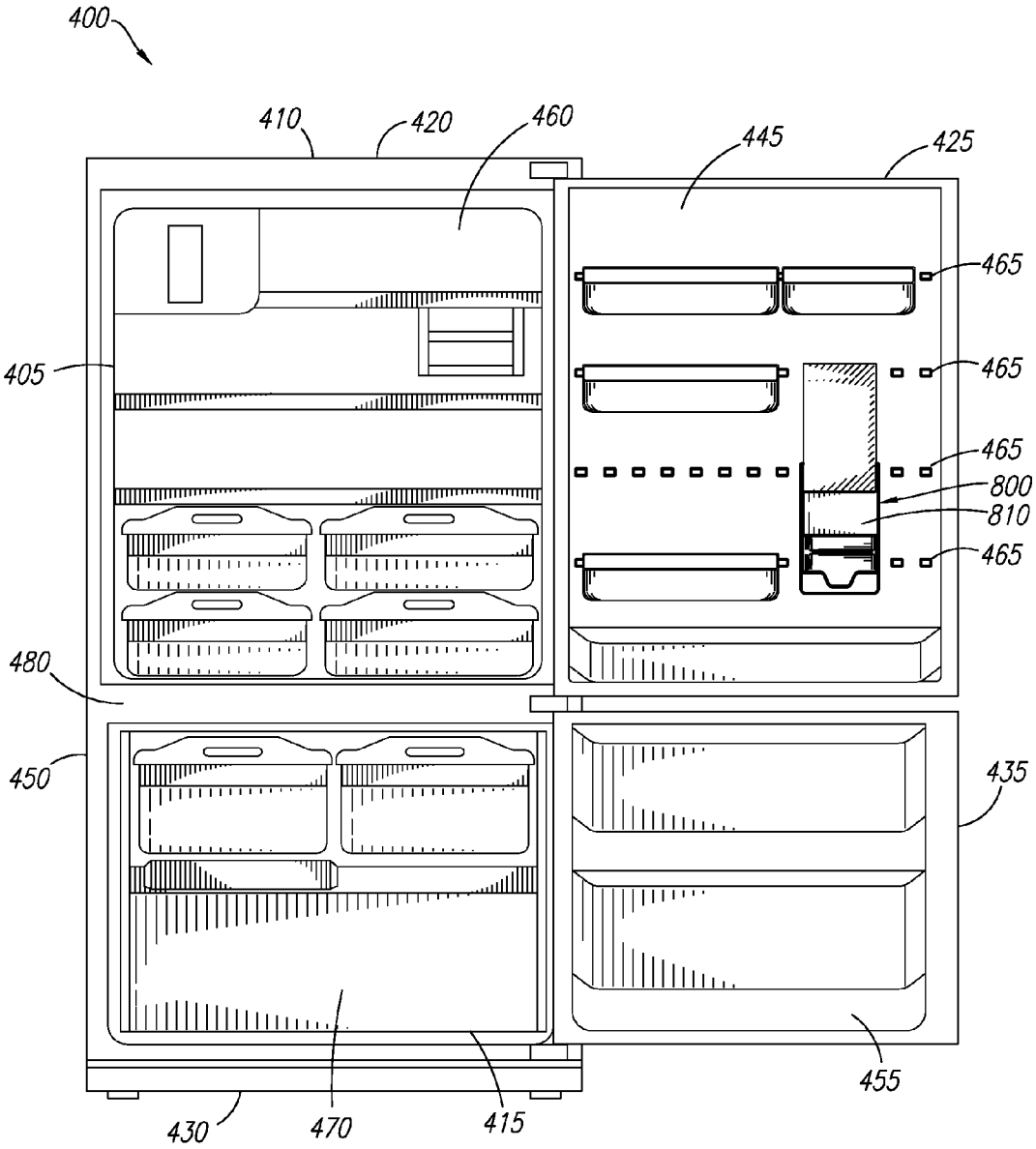
FIG. 2 is a front view illustrating an example of a refrigerator according to an embodiment.

FIG. 1 is a front view illustrating an example of a refrigerator 100 according to an embodiment. FIG. 2 is a front view illustrating an example of a refrigerator 400 according to an embodiment. While refrigerators 100 and 400 are illustrated as being bottom-mount refrigerators, embodiments disclosed herein are not limited thereto. For example, a side-by-side refrigerator, a top-mount refrigerator, a full refrigerator, a cabinet refrigerator, a compact refrigerator, a wine storage refrigerator, or a freezer may be included in the disclosed embodiments.

As is illustrated in FIG. 1, the refrigerator 100 may include an insulated cabinet 110. The insulated cabinet 110 may include a top wall 120, a bottom wall 130, a rear wall (not shown), side walls 150, an upper opening 160, a lower opening 170, and a mullion 180. The rear wall may contact the top wall 120, the bottom wall 130, the side walls 150, and the mullion 180. The side walls 150 may contact the top wall 120, the bottom wall 130, and the rear wall. The upper opening 160 may be defined by the top wall 120, the side walls 150, the rear wall, and the mullion 180. The lower opening 170 may be defined by the bottom wall 130, the rear wall, the side walls 150, and the mullion 180.

A fresh food liner 105 may be provided in the upper opening 160. The fresh food liner 105 may define a fresh food compartment. A freezer liner 115 may be provided in the lower opening 170. The freezer liner 115 may define a freezer compartment. Both the fresh food compartment 105 and the freezer compartment 115 may include a variety of storage units and shelves for placing items therein or thereon, respectively.

An insulated fresh food door 125 may be configured to close the upper opening 160 corresponding with the fresh food compartment 105. The fresh food door 125 may face the fresh food compartment 105 when closed. An insulated freezer door 135 may be configured to close the lower opening 170 corresponding with the freezer compartment 115. The freezer door 135 may face the freezer compartment 115 when closed. Both the fresh food door 125 and the freezer door 135 may include a variety of storage units mounted on inner walls 145 and 155 thereof, respectively.

The inner wall 145 of the fresh food door 125 may include recesses 190 therein. Each of the recesses 190 may stretch across a substantial width of the inner wall 145. Each of the recesses 190 may occupy the inner wall 145 at a particular height that differs from the other recesses 190. An opening of each of the recesses 190 within the inner wall 145 may be defined by a portion of the inner wall 145 and a horizontal rail 165 installed at and defining a bottom of the openings. A portion of the inner wall 145 may define sides and a top of the opening of each of the recesses 190. The recesses 190 may extend into the fresh food door 125 from the openings in the inner wall 145 and behind the horizontal rails 165. The recesses 190 may be designed to accommodate a variety of mounting configurations of different storage units that would correspond with the recesses 190 and the horizontal rails 165.

While openings of the recesses 190 are illustrated in FIG. 1 as being partially defined by horizontal rails 165, embodiments disclosed herein are not limited thereto. For example, the recesses 190 could be defined solely by construction of the inner wall 145. Further, while it is illustrated in FIG. 1 that the recesses 190 are disposed solely on the inner wall 145 of the fresh food door 125, embodiments disclosed herein are not limited thereto. For example, the recesses 190 may additionally be included within the inner wall 155 of the freezer door 135. In addition, the recesses 190 may further be included within the side walls 150 or the rear wall of the insulated cabinet 110.

Figure 5:
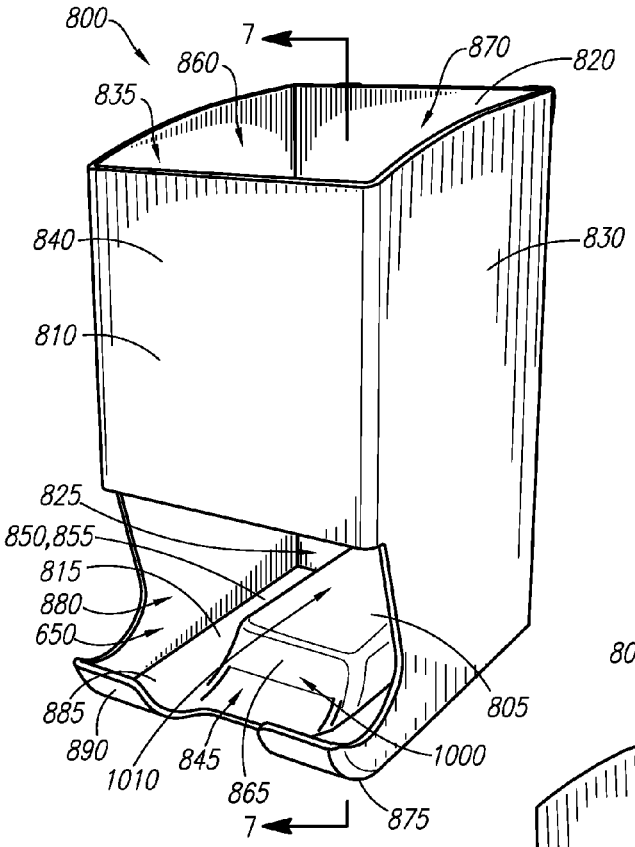
FIG. 5 is a front perspective view illustrating an example of an article dispenser according to an embodiment.
Figure 6:
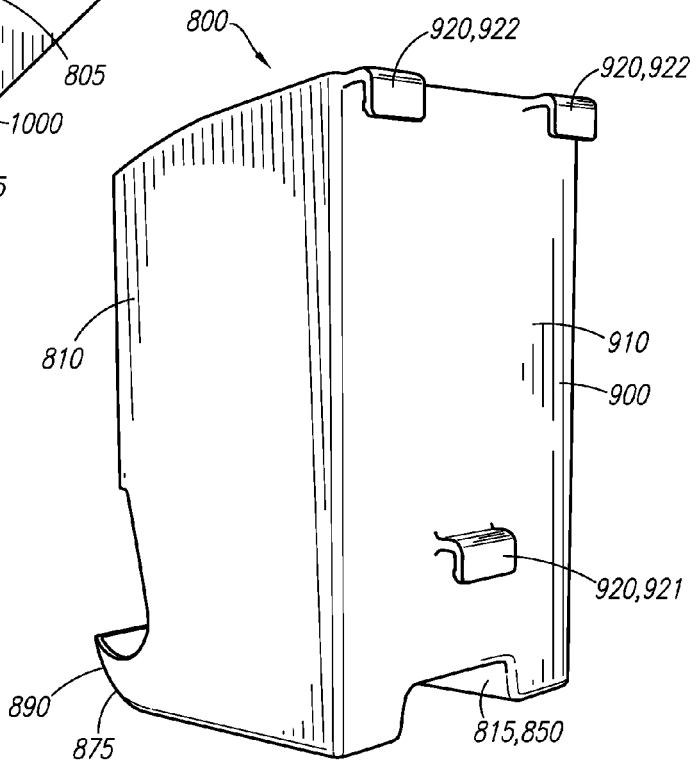
FIG. 6 is a rear perspective view illustrating an example of an article dispenser according to an embodiment.

An article dispenser 800 may be removably mounted over the horizontal rails 165 and within the recesses 190 in the inner wall 145. The article dispenser 800 may include a dispensing portion 810 and a mounting portion 900, which is illustrated in FIGS. 5 and 6. The dispensing portion 810 may be configured to store various types of articles and dispense them upon demand by a user. The mounting portion 900 may be provided on a back side 910 of the dispensing portion 810, which is illustrated in FIGS. 5 and 6.

The mounting of the article dispenser 800 within the recesses 190 by the mounting portion 900 may be achieved using any type of mounting member having a shape that would correspond to a shape of the recesses 190. For example, as is illustrated in FIGS. 5 and 6, curved fasteners 920 may be configured to enter the recesses 190 and hang on the horizontal rails 165 at the opening of the recesses 190 to removably mount the article dispenser 800 to the inner wall 145. However, embodiments are not limited thereto, as any type of removable curved fastener, such as, but not limited to, anchors, grapples, hangers, or hooks, may be used to mount the article dispenser 800 to the inner wall 145. Further, both mounting members of the mounting portion 900 and the horizontal rails 165 may additionally be configured to allow the article dispenser 800 to slide along the width of the horizontal rails 165.

While FIG. 1 illustrates a refrigerator 100 having recesses 190 extending horizontally across a width of the inner wall 145, embodiments disclosed herein are not limited thereto. For example, as is illustrated in FIG. 2, the refrigerator 400 may include an insulated cabinet 410. The insulated cabinet 410 may include a top wall 420, a bottom wall 430, a rear wall (not shown), side walls 450, an upper opening 460, a lower opening 470, and a mullion 480. The rear wall may contact the top wall 420, the bottom wall 430, the side walls 450, and the mullion 480. The side walls 450 may contact the top wall 420, the bottom wall 430, and the rear wall. The upper opening 460 may be defined by the top wall 420, the side walls 450, the rear wall, and the mullion 480. The lower opening 470 may be defined by the bottom wall 430, the rear wall, the side walls 450, and the mullion 480.

A fresh food liner 405 may be provided in the upper opening 460. The fresh food liner 405 may define a fresh food compartment. A freezer liner 415 may be provided in the lower opening 470. The freezer liner 415 may define a freezer compartment. Both the fresh food compartment 405 and the freezer compartment 415 may include a variety of storage units and shelves for placing items therein or thereon, respectively.

An insulated fresh food door 425 may be configured to close the upper opening 460 corresponding with the fresh food compartment 405. The fresh food door 425 may face the fresh food compartment 405 when closed. An insulated freezer door 435 may be configured to close the lower opening 470 corresponding with the freezer compartment 115. The freezer door 435 may face the freezer compartment 415 when closed. Both the fresh food door 425 and the freezer door 435 may include a variety of storage units mounted on inner walls 445 and 455 thereof, respectively.

The inner wall 445 of the fresh food door 425 may include rows of recesses 465 therein. The rows of the recesses 465 may stretch substantially across a width of the inner wall 445. However, unlike the recesses 190 of FIG. 1, the recesses 465 themselves may not extend substantially across the width of the inner wall 445. A row of recesses 465 may occupy the inner wall 445 at a particular height that differs from all other rows of recesses 465. An opening of each of the recesses 465 may be defined by the inner wall 445. The recesses 465 may extend into and behind portions of the inner wall 445 defining openings of the recesses 465. The recesses 465 may be designed to accommodate a variety of mounting configurations of different storage units that would correspond with the recesses 465.

While it is illustrated in FIG. 2 that the recesses 465 are disposed solely on the inner wall 445 of the fresh food door 425, embodiments disclosed herein are not limited thereto. For example, the recesses 465 may additionally be included within the inner wall 455 of the freezer door 435. Further, the recesses 465 may be included within the side walls 450 and the rear wall of the insulated cabinet 410.

The article dispenser 800 may be removably mounted to the key-shaped recesses 465. The mounting within the recesses 465 by the mounting portion 900 may be achieved using any type of mounting member having a shape that would correspond to a shape of the recesses 465. For example, as is illustrated in FIGS. 5 and 6, curved fasteners 920 may be configured to enter within the recesses 465 to removably mount the article dispenser 800 to the inner wall 445. However, embodiments are not limited thereto, as any type of removable curved fastener, such as, but not limited to, anchors, grapples, hangers, or hooks, may be used to mount the article dispenser 800 to the inner wall 445.

While FIG. 1 describes refrigerator 100 having recesses 190 and FIG. 2 describes refrigerator 400 having recesses 465, embodiments described herein are not limited thereto. For example, the article dispenser 800 may be affixed to the inner walls 145 and 445 of the fresh food doors 125 and 425 by anything provided thereon or therein that allows the inner walls 145 and 445 of the fresh food doors 125 and 425 to correspond with mounting members 920 of the mounting portion 900 of the article dispenser 800, such as, but not limited to, hooks, cords, mounted receptacles, pedestals, and knobs.

Figure 3:
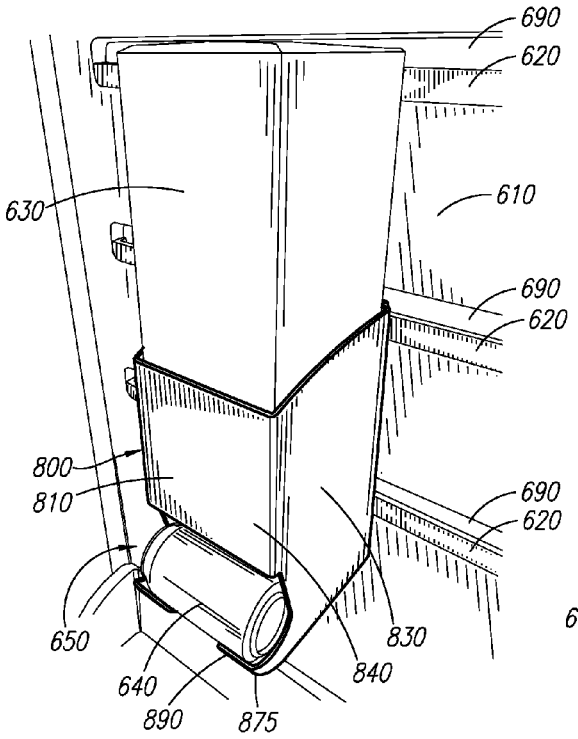
FIG. 3 is a front perspective view illustrating an example of an article dispenser mounted on an inner wall of a refrigerator door according to an embodiment.
Figure 4:
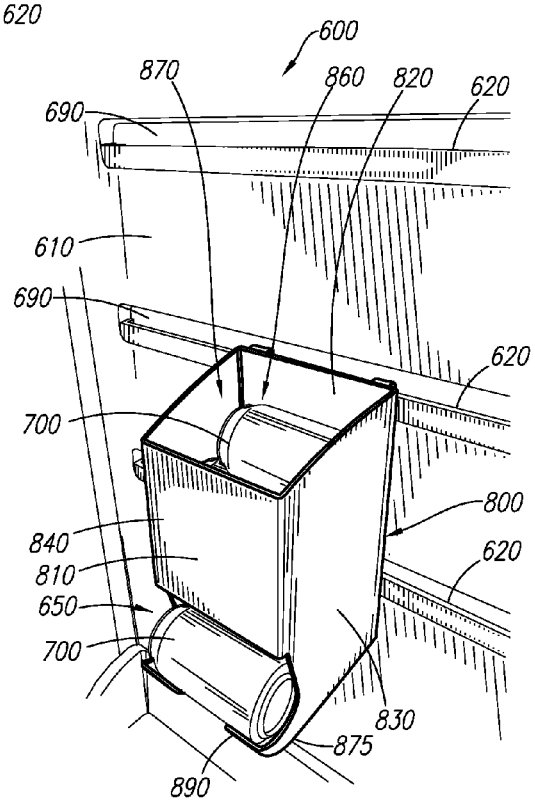
FIG. 4 is a front perspective view illustrating an example of an article dispenser mounted on an inner wall of a refrigerator door according to an embodiment.
Figure 7:
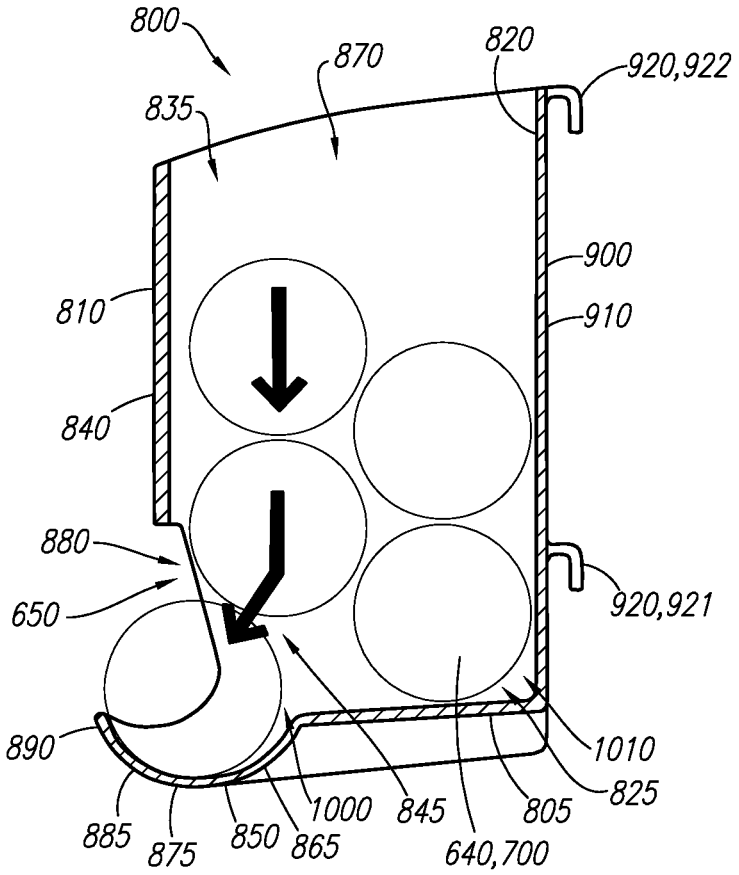
FIG. 7 is a sectional view illustrating an example of an article dispenser according to an embodiment.

FIG. 3 is a front perspective view illustrating an example of the article dispenser 800 mounted on an inner wall 610 of a refrigerator door 600 according to an embodiment. FIG. 4 is a front perspective view illustrating an example of the article dispenser 800 mounted on the inner wall 610 of the refrigerator door 600 according to an embodiment. FIG. 5 is a front perspective view illustrating an example of the article dispenser 800 according to an embodiment. FIG. 6 is a rear perspective view illustrating an example of the article dispenser 800 according to an embodiment. FIG. 7 is a sectional view illustrating an example of the article dispenser 800 according to an embodiment.

As is illustrated in FIGS. 3 and 4, a refrigerator door 600 may include recesses 690 provided on an inner wall 610 of the door 600. An opening of the recesses 690 may be partially defined by horizontal rails 620. The horizontal rails 620 may be configured to allow various storage units, including the article dispenser 800, to rest thereon via curved fasteners 920 illustrated in FIGS. 6 and 7. The horizontal rails 620, along with the recesses 690, may extend across a substantial width of the inner wall 610.

While the refrigerator door 600 illustrated in FIGS. 3 and 4 includes recesses 690 provided on the inner wall 610 of the door 600 and having an opening partially defined by horizontal rails 620, embodiments disclosed herein are not limited thereto. For example, rows of recesses similar to those illustrated in FIG. 2 may be provided on the inner wall 610 of the door 600 for allowing various storage units, including the article dispenser 800, to be mounted thereon via curved fasteners 920. The rows of recesses similar to those illustrated in FIG. 2 may extend across a substantial width of the inner wall 610.

The article dispenser 800 may include the dispensing portion 810. The dispensing portion 810 may include a bottom wall 850 (illustrated in FIG. 6), a step 805 elevated from the bottom wall 850, and an article holding area including a rear wall 820, side walls 830, a front wall 840, an upper opening 860, an enclosed portion 870, and an open portion 880.

The dispensing portion 810 may additionally include an article dispensing area including a front edge 875 of the bottom wall 850 and a lip 890 provided on the front edge 875 of the bottom wall 850. The article dispensing area may be provided through a lower opening 650 of the open portion 800 on which articles 640 and 700 can be held and subsequently resist force provided as a result of articles 700 or 640 falling from the enclosed portion 870 while awaiting retrieval by a user. The lip 890 may be provided at a position in front of the front wall 840.

The rear wall 820 may include the mounting portion 900 and the curved fasteners 920 on a back side 910 thereof, as previously indicated with respect to FIGS. 6 and 7. As previously indicated, the curved fasteners 920 may be configured to be removably mounted to the inner wall 610 of the door 600 via the horizontal rails 620. The curved fasteners 920 may additionally be slidably mounted on the horizontal rails 620 within the recesses 690 and may serve to slidably mount the dispensing portion 810 to the horizontal rails 620. In other words, the curved fasteners 920 may be enabled to slide along a width of the horizontal rails 620 and recesses 690.

The upper opening 860 may be defined by the rear wall 820, the side walls 830, and the front wall 840 of the dispensing portion 810. The upper opening 860 may be configured to accept articles 700 or a vertically oriented carton 630 containing articles 640. The bottom wall 850 may be connected to the rear wall 820 and the side walls 830. The front wall 840 may be connected to the side walls 830. The side walls 830 may be connected to the front wall 840, the rear wall 820, and the bottom wall 850. The bottom wall 850 may be inclined by a step 805, as is shown in FIGS. 5 and 7, to urge articles 640 and 700 falling downward in the enclosed area 870 toward a lower opening 650 adjacent to the bottom front 1000 of the bottom wall 850 and the article dispensing area. The bottom wall 850 may be configured to inhibit articles 640 and 700 disposed at a bottom rear 1010 of the bottom wall 850 from moving to the bottom front 1000 of the bottom wall 850.

As is illustrated in FIG. 6, a central hook 921 may be provided at a central portion of the mounting portion 900 on the back side 910 of the rear wall 820 and the dispensing portion 810. Further, edge hooks 922 may be provided at a top portion of the mounting portion 900 on the back side 910 of the rear wall 820 and the dispensing portion 810. The central hook 921 and the edge hooks 922 may be configured to correspond to a location of two adjacent recesses 690 for mounting thereon.

The enclosed portion 870 may be defined by the rear wall 820, the side walls 830, and the front wall 840 of the dispensing portion 810. The enclosed portion 870 may be configured to store articles 700 or a carton 630 containing articles 640. The open portion 880 may be provided underneath the enclosed portion 870. The open portion 880 may be defined by the rear wall 820, the side walls 830, and the bottom wall 850 of the dispensing portion 810. The open portion 880 may be configured to stage articles 640 or 700 falling from the enclosed portion 870 for retrieval by a user through the lower opening 650 of the open portion 880 adjacent to the bottom front 1000 of the bottom wall 850.

The step 805 may be connected to the rear wall 820 and adjacent portions 855 of the bottom wall 850 provided underneath the step 805. The step 805 may be provided in a rear portion 825 of the open portion 880. The step 805 may be configured to allow the articles 700 or 640 to rest thereon and urge the articles 700 or 640 falling from a front portion 835 of the enclosed portion 870 into a front portion 845 of the open portion 880 through the front portion 845 of the open portion 880 onto the lip 890 of the bottom wall 850 for retrieval by a user. The lip 890 may inhibit articles 700 or 640 from being urged by the step 805 from exiting the dispensing portion 810 through the lower opening 650 of the open portion 880 without being retrieved by a user.

As is shown in FIG. 7, the step 805 may also be configured to inhibit articles 700 or 640 falling from a position above the step 805 from moving towards the open portion 880 and the article dispensing area from the bottom rear 1010 of the bottom wall 850. The step 805 may additionally include an incline 865 facing the open portion 880 and the lip 890. The incline 865 may be configured to urge articles falling from above the incline 865 toward the lip 890. The area of the bottom wall 850 between the incline 865 and the lip 890 may be a curved depression 885 shaped to accommodate a shape of articles 700 or 640.

FIGS. 3, 4, and 7 illustrate the article dispenser 800 as dispensing articles 640 and 700 that are similar to cylindrical beverage containers and FIGS. 1-3 illustrate the article dispenser 800 as supporting a vertically oriented carton 630 configured to support the cylindrical beverage containers 640 and 700. However, embodiments disclosed herein are not limited thereto. For example, a variety of articles could be dispensed using the article dispenser 800, such as, but not limited to, butter or cream cheese sticks, yogurt sticks and containers, condiment packets, cheese blocks, water bottles, concentrated orange juice containers packaged fruits or pudding, individual-serving creamer or cheese containers, and various other articles typically stored in either a fresh food compartment or freezer compartment that can be dispensed in a single unit fashion.

A number of examples have been described above. Nevertheless, it will be understood that various modifications may be made. For example, suitable results may be achieved if the described elements are combined in a different manner and/or replaced or supplemented by other elements or their equivalents. Accordingly, other implementations are within the scope of the following claims.

What is claimed is:

1. A refrigerator, comprising:

an insulated cabinet configured to preserve food;

an insulated door mounted on the insulated cabinet, the insulated door being configured to close the insulated cabinet, the insulated door comprising an inner wall; and an article dispenser comprising a dispensing portion and a mounting portion on a back side of the dispensing portion, the dispensing portion comprising a bottom wall, an article holding area, a step, and an article dispensing area including an opening in a lower portion of the article holding area, the article holding area being configured to position like articles in first and second columns, the article dispensing area receiving a bottom one of the articles positioned in the first column and holding the received article for retrieval by a user via the opening, the step having an upper surface elevated from the bottom wall and positioned to correspond with the second column, wherein an article positioned in the first column immediately above the received article is spaced from the upper surface of the step and rests on the received article, the step maintaining a bottom of an article positioned in the second column at a height above a height of a bottom of the received article in the article dispensing area, the mounting portion removably and slidably mounting the dispensing portion to the inner wall.

2. An insulated door mounted on an insulated cabinet of a refrigerator, the insulated door comprising:

an inner wall; and an article dispenser comprising a dispensing portion and a mounting portion on a back side of the dispensing portion, the mounting portion being mounted to recesses in the inner wall and enabling the article dispenser to slide horizontally within the recesses, the dispensing portion comprising a bottom wall, an article holding area, a step, and an article dispensing area including an opening in a lower portion of the article holding area, the article holding area being configured to position like articles in first and second columns, the article dispensing area receiving a bottom one of the articles positioned in the first column and holding the received article for retrieval by a user via the opening, the step having an upper surface elevated from the bottom wall and positioned to correspond with the second column, the step maintaining a bottom of an article positioned in the second column at a height above a height of a bottom of the received article in the article dispensing area, the mounting portion removably mounting the dispensing portion to the inner wall.

3. The door of claim 2, wherein an opening of each of the recesses is defined by a hole in the inner wall, a plurality of the holes extending in horizontal rows across a substantial width of the inner wall, and wherein the mounting portion comprises one or more mounting members, the mounting members resting on portions of the inner wall corresponding with the holes defining the recesses within which the mounting members are removably mounted, the mounting members further extending past the corresponding inner wall portions into the recesses.

4. The door of claim 3, wherein the mounting members comprise hooks.

5. The door of claim 3, wherein a first plurality of the mounting members is removably mounted in a corresponding first plurality of the recesses along a first one of the horizontal rows, and wherein a second plurality of the mounting members is removably mounted in a corresponding second plurality of the recesses along a second one of the horizontal rows, the second one of the horizontal rows being located adjacent to and below the first set of horizontal rows.

6. An insulated door mounted on an insulated cabinet of a refrigerator, the insulated door comprising:

an inner wall, wherein the inner wall includes recesses and an opening of each of the recesses is partially defined by a rail that, along with the recess, extends horizontally across a substantial width of the inner wall, and an article dispenser comprising a dispensing portion and a mounting portion on a back side of the dispensing portion, the dispensing portion comprising a bottom wall, an article holding area, a step, and an article dispensing area including an opening in a lower portion of the article holding area, the article holding area being configured to position like articles in first and second columns, the article dispensing area receiving a bottom one of the articles positioned in the first column and holding the received article for retrieval by a user via the opening, the step having an upper surface elevated from the bottom wall and positioned to correspond with the second column, the step maintaining a bottom of an article positioned in the second column at a height above a height of a bottom of the received article in the article dispensing area, the mounting portion removably mounting the dispensing portion to the inner wall, wherein the mounting portion comprises one or more mounting members, the mounting members resting and sliding on the horizontal rails corresponding with the one or more recesses within which the mounting members are removably mounted, the mounting members further extending past the corresponding horizontal rails into the recesses.

7. The door of claim 6, wherein the mounting members comprise curved fasteners.

8. The door of claim 6, wherein a first plurality of the mounting members is slidably and removably mounted in a first one of the recesses, and wherein a second plurality of the mounting members is slidably and removably mounted in a second one of the recesses located below and adjacent to the first one of the recesses.

9. An article dispenser for mounting to an inner wall of a refrigerator door, the dispenser comprising:

a dispensing portion configured to store one or more articles and dispense the articles according to a user's demand the dispensing portion comprising a bottom wall, an article holding area, a step, and an article dispensing area including an opening in a lower portion of the article holding area, the article holding area being configured to position like articles in first and second columns, the article dispensing area receiving a bottom one of the articles positioned in the first column and holding the received article for retrieval by a user via the opening, the step having an upper surface elevated from the bottom wall and positioned to correspond with the second column, the step maintaining a bottom of an article positioned in the second column at a height above a height of a bottom of the received article in the article dispensing area, wherein the bottom wall defines a curved depression for receiving the article in the dispensing area; and a mounting portion on a back side of the dispensing portion, the mounting portion removably mounting the dispensing portion to the inner wall.

10. The article dispenser of claim 9, further comprising a lip at a front of the bottom wall for retaining the article in the dispensing area.

11. The article dispenser of claim 9, wherein the mounting portion comprises mounting members extending from the mounting portion that correspond with locations of recesses in the inner wall and the mounting members comprise a first plurality and a second plurality of the mounting members, the first plurality of the mounting members being slidably and removably mountable in a first one of the recesses, the second plurality of the mounting members being slidably and removably mountable in a second one of the recesses located below and adjacent to the first one of the recesses.

12. The article dispenser of claim 9 , wherein the mounting portion includes mounting members that comprise a first plurality and a second plurality of mounting members, the first plurality of the mounting members being removably mountable in a corresponding first plurality of recesses that extend across a substantial width of the inner wall, the second plurality of the mounting members being removably mountable in a corresponding second plurality of recesses that extend the substantial width of the inner wall and are located adjacent and below the first plurality of recesses.

13. The article dispenser of claim 9, wherein the step maintains a position of articles positioned in the second column while the bottom article in the first column is received by the article dispensing area and the step allows one of the articles positioned in the second column to move to the first column when a final article in the first column is received by the article dispensing area.

14. The article dispenser of claim 13, wherein the articles in the first column are diagonally positioned with respect to the articles in the second column.

15. The article dispenser of claim 14, wherein the articles comprise a plurality of cylindrical beverage containers.

16. The article dispenser of claim 15, wherein the cylindrical beverage containers are separated from surfaces of the article holding area by a carton configured to hold the cylindrical beverage containers.

* * * * *